US005429300A

United States Patent [19]

Berna

[11] Patent Number: 5,429,300

[45] Date of Patent: Jul. 4, 1995

[54] KEY-LOCK SPIKE

[76] Inventor: Jim J. Berna, 33917 Road 112, Visalia, Calif. 93291

[21] Appl. No.: 180,853

[22] Filed: Jan. 12, 1994

[51] Int. Cl.[6] ..... E01B 9/12

[52] U.S. Cl. ..... 238/374; 238/375; 411/469; 411/511

[58] Field of Search ..... 238/366, 367, 368, 374, 238/375; 411/469, 482, 511, 516, 530

[56] References Cited

U.S. PATENT DOCUMENTS

| | | | |
|---|---|---|---|
| 2,182 | 7/1841 | Ballard . | |
| 82,900 | 10/1868 | Walton | 411/469 |
| 971,308 | 9/1910 | Radoman . | |
| 1,409,403 | 3/1922 | Plump | 238/375 X |
| 1,444,271 | 2/1923 | Plump | 238/375 |
| 2,016,845 | 10/1935 | Turner | 238/368 |
| 2,389,464 | 11/1945 | Snyder | 238/366 |
| 2,677,298 | 5/1954 | Hebenstreit | 238/375 X |
| 3,865,307 | 2/1975 | Schiro | 238/375 X |

*Primary Examiner*—Robert J. Oberleitner
*Assistant Examiner*—S. Joseph Morano
*Attorney, Agent, or Firm*—Mark D. Miller

[57] ABSTRACT

A two-piece locking spike which includes a first shaft having a longitudinal groove extending from the top of the shaft approximately one third of the way down along one side to a tapered bottom. A second shaft is also provided which fits into said longitudinal groove and which includes a tapered point at the bottom which corresponds to the tapered bottom of said groove. After the first shaft is inserted into a medium, the second shaft (which is longer than the groove) is inserted into the groove so that when fully inserted, the bottom of the second shaft protrudes into the medium at a different angle than the first shaft. This interaction helps lock the first shaft more snugly in place in the medium. Several alternative embodiments are available including rounded and squared spikes, nails, and screws.

14 Claims, 6 Drawing Sheets

KEY-LOCK SPIKE

BACKGROUND OF THE INVENTION

The present invention relates to nails and spikes, and more particularly to a novel two-piece key-lockable nail, spike or screw which provides dramatically improved holding ability.

SUMMARY OF THE INVENTION

Railroad spikes, railroad screw spikes, bridge spikes, and other nails are well known in the industry. The function of these various varieties of nails or screws is to firmly hold different parts together. Railroad spikes are used to hold steel rails against wooden railroad ties; bridge spikes are used to hold wooden piers or bridge tresles together; railroad screw-type spikes are used to hold steel rails to railroad ties at intersections; longer railroad screws are used to hold multiple railroad ties together; and nails are used for unlimited connective purposes.

In the example of the railroad spike, repeated compression and decompression of the rails and ties by the wheels of trains passing over them eventually causes loosening of the spike. The result of this slippage is a loosening of the rails which may lead to derailment of trains with loss of property, and possibly, loss of life. Railroad companies spend enormous amounts of time and money constantly inspecting and replacing or tightening spikes to prevent such unstable tracks and the possibility of disastrous derailments.

Similarly, wooden bridges, piers and docks are held together with specially designed spikes. Over time, changes in weather, temperature, pressure as well as constant use and buffeting also result in the loosening of these spikes, leading to the instability of the bridge, dock, pier or other structure. In fact, in almost any connective situation involving a nail, screw, or spike, the varying stresses and pressures which are applied to the parts held in connection by the screw, spike, or nail can result in the loosening and diminishment of the connection.

The present invention solves these problems by providing a spike, screw or nail having a longitudinal groove cut into one side extending from the top down approximately one third of the length of the shaft of the spike. This groove (the "key way") is open at the top near the head of the screw, spike or nail, and is tapered at the end opposite the top. A separate nail (the "key") sometimes having one or more heads thereon is provided which fits into the key way. The key is longer than the key way, and is tapered at the bottom in conformity with the taper in the key way itself. These pieces (the spike with the key way, and the key itself) are designed to be used together to add increased connective stability to any nail, spike or screw situation.

The main nail, screw or spike having the key way therein is first introduced to the selected medium. Once it is firmly in place, the key is then inserted into the key way and hammered into place. This hammering process causes the lower portion of the key to be bent outward at an angle away from the shaft of the main nail, screw, or spike and into the medium into which the nail, screw or spike has already been introduced. This angled insertion into the medium provides greater stability to the shaft, since it provides more than just the downward angle of connection that the shaft would otherwise provide.

It is therefore the most important object of the present invention to provide a two piece key lock nail, spike or screw which provides greater connective stability when introduced into wood, concrete, or another appropriate medium.

Another important object of the present invention is to provide a locking nail, spike, or screw which provides not only the downward connection from the shaft of the nail, spike or screw, but also the connective and stabilizing characteristics associated with the angled key lock piece.

It is also an important object of the present invention to provide a main elongated nail, spike or screw having a vertical slot therein extending from the top (head) part way down the shaft, said slot being angled at the bottom in conformance with a separate nail which fits into said slot and which is correspondingly angled at the bottom, such that after said main nail, spike or screw is inserted into a medium, said nail may subsequently be inserted into the said vertical slot so that when said nail reaches the bottom of the slot, it bends at an angle into the medium thereby providing another means of connection and greater stability.

It is also an object of the present invention to provide a key lock screw-type railroad spike which may be used at railroad grade crossings, or other high traffic areas.

It is also an important object of the present invention to provide a safety device that reduces the chances of rail slippage on rail car.

It is also an important object of the present invention to provide an elongated cylindrical key lock spike which may be used to connect multiple railroad ties together.

It is also an important object of the present invention to provide a safety device that helps prevent rail rollover.

It is also an object of the present invention to provide an elongated key lock spike which may be used to hold together bridge, pier or boating docks.

It is also an object of the present invention to provide a key lock nail which may be used for multiple applications.

DESCRIPTION OF THE PREFERRED EMBODIMENT

Figure 2:
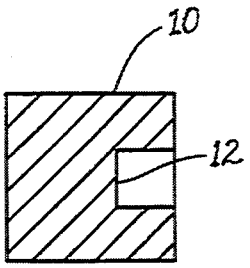
FIG. 2 is a cut away view along line 2—2 of FIG. 1.
Figure 1:
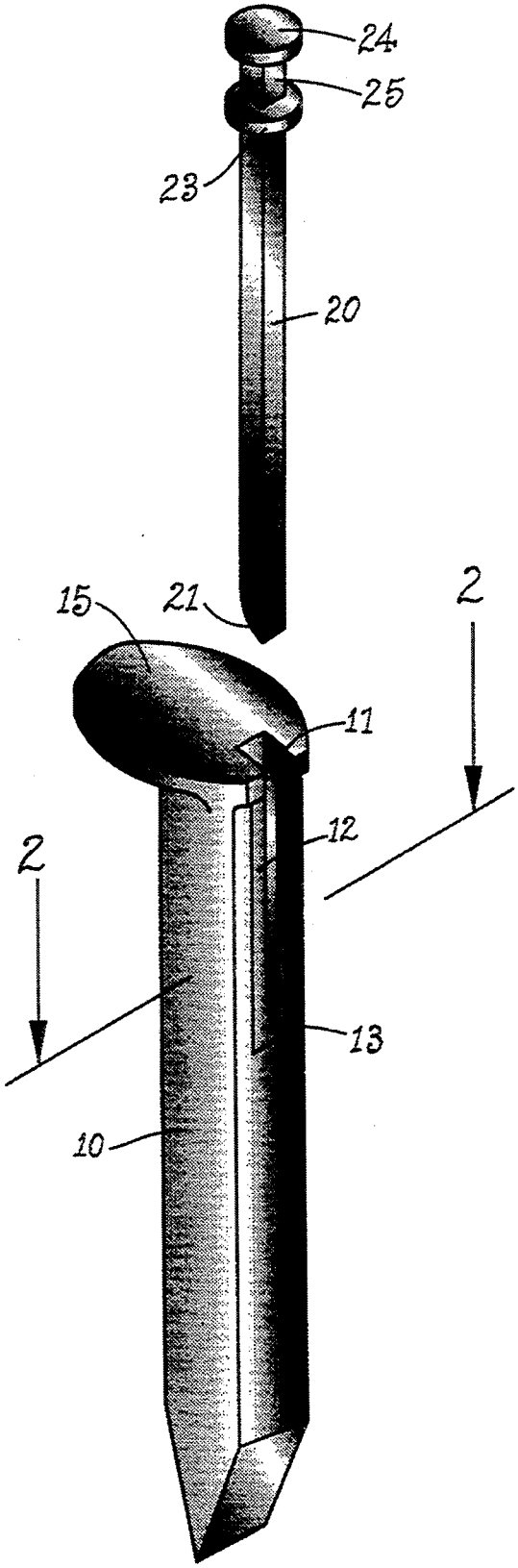
FIG. 1 is a perspective view of the railroad spike version of the present invention showing the railroad spike with the groove (key way) therein, and the nail (key) poised above it for insertion.

The preferred embodiment of the present invention is a modified railroad spike having a square shaft 10 having a point at one end and a head 15 at the opposite end. In the railroad spike version, head 15 extends outwardly over one side of the shaft 10 to form a lip which is used to engage the track rail 17. This spike is generally constructed of a metal alloy. A vertical slot (or key way) 12 is formed in the spike on the side opposite the lip. Key way 12 is cut into the head at 11 and extends downwardly approximately one third of the length of shaft 10. The bottom edge 13 of key way 12 is outwardly tapered. The sides of key way 12 may be flat with well defined corners as shown in FIG. 1, but also may be rounded.

A separate nail (or key) 20 is provided which is longer than key way 12. The bottom of key 20 is tapered at edge 21 which corresponds to the bottom 13 of key way 12. Key 20 is longer than key way 12 and is designed to be inserted into key way 12. When pressure is applied to key 20, the bottom edge 21 comes into contact with the bottom edge 13 of key way 12. The contact between edge 21 on the key and edge 13 on the key way forces key 20 to bend outwardly as shown in FIG. 5, and FIGS. 6D–6F. As key 20 is pounded into place, its bottom 21 is forced out to the side and into the medium at a different angle from shaft 10. This results in a stronger connection than would be otherwise available with a simple shafted spike. This "lock" is made possible by the interaction of the key 20 in the key way 12.

Figure 3:
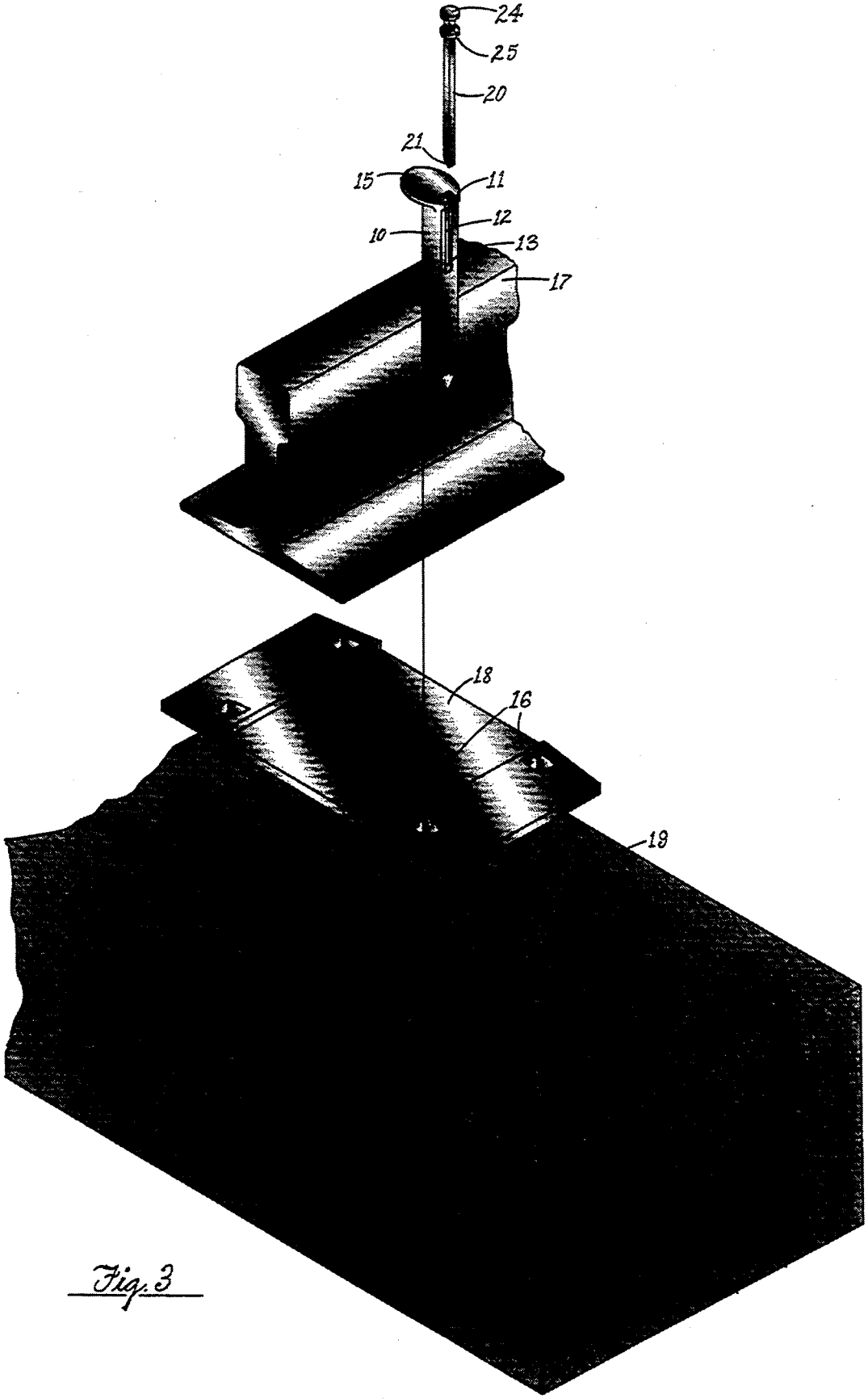
FIG. 3 is a schematic view showing how the key lock railroad spike version of the present invention fits over the rail, into a steel plate, and thereafter into the railroad tie itself.
Figure 4:
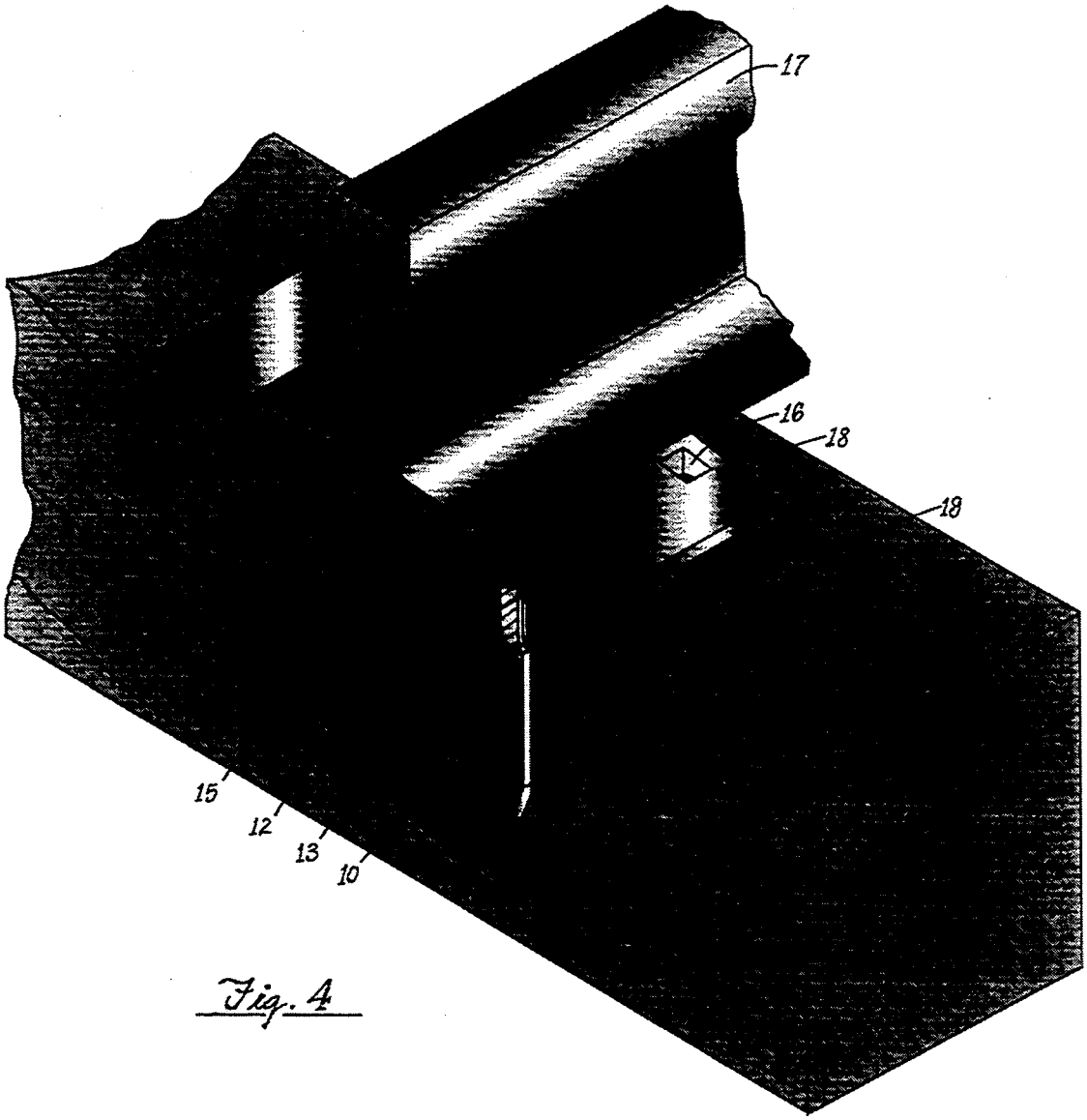
FIG. 4 is a perspective view of the railroad spike version of the present invention showing the spike (only) after insertion into the metal plate holding the steel rail in place.
Figure 5:
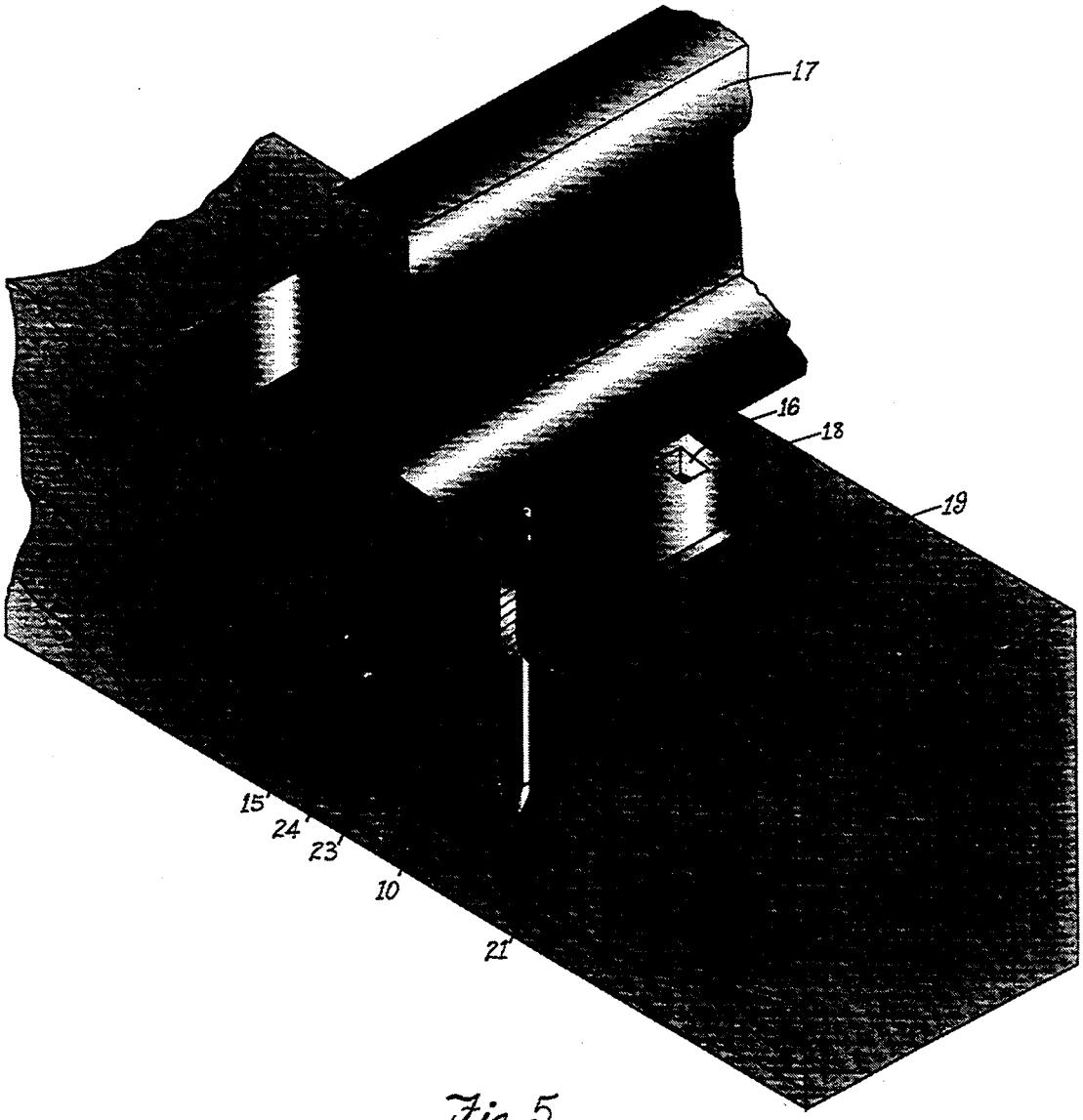
FIG. 5 is a perspective cut away view showing the railroad spike version of the invention in place, together with the locking nail (key) of the present invention after it has been inserted into the slot (key way) of the spike.
Figures 6A, 6B, 6C, 6D, 6E, 6F:
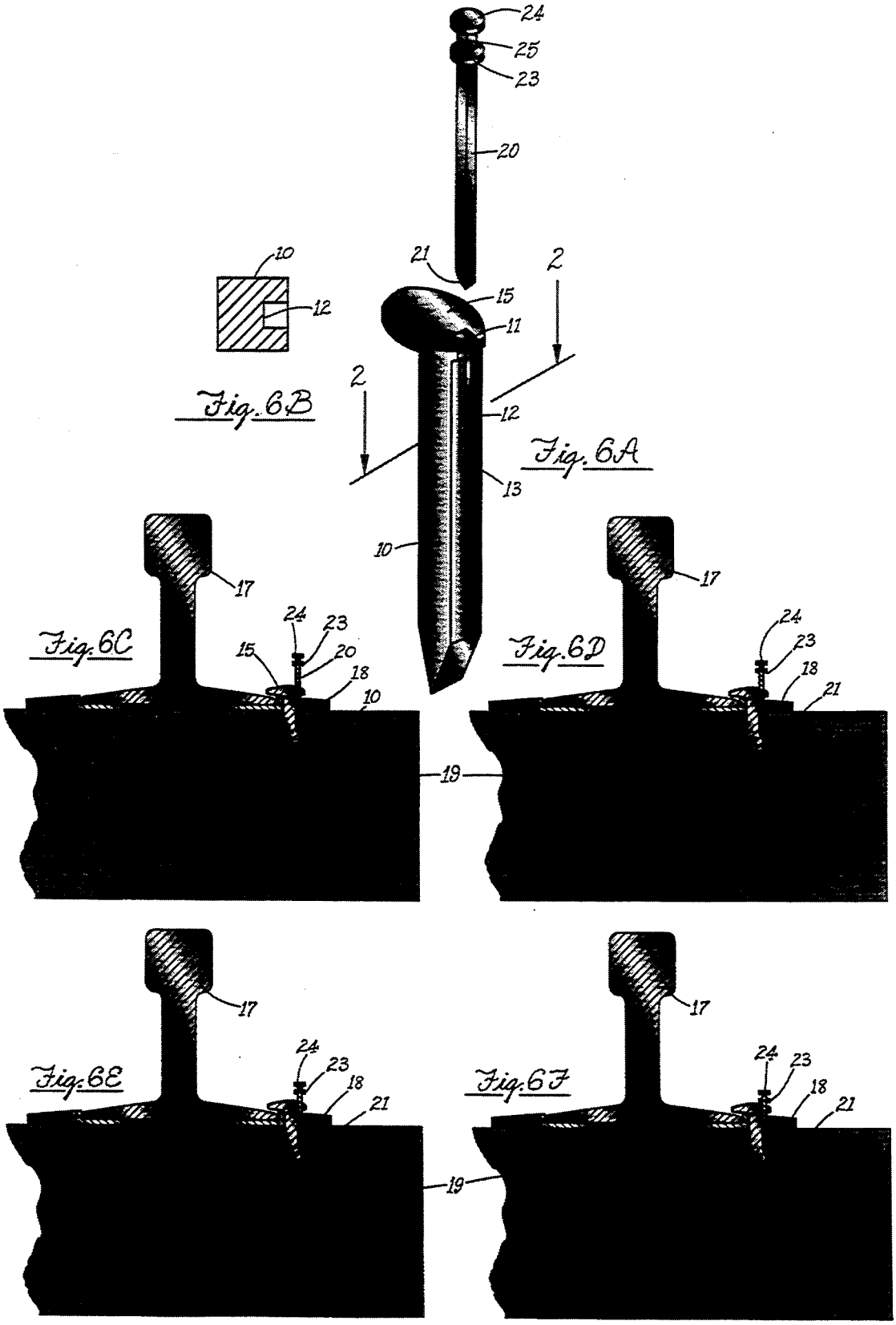
FIG. 6A is a perspective view of the railroad spike version of the present invention showing the railroad spike with the groove (key way) therein, and the nail (key) poised above it for insertion.
FIG. 6B is a cut away view a long line 2—2 of FIG. 1.
FIGS. 6C–6F are a series of views showing the gradual insertion of the key into the key way of the spike from its initial insertion to its complete insertion (6F) showing the penetration of the key into the railroad tie.

In the preferred embodiment, a pair of heads 23, 24 are provided on key 20, separated by shaft 25. The second head 24 allows for easy removal of key 20 in the event the shaft 10 must be removed. It is also important to recognize the interaction of key 20 and shaft 10 with base plate 18 and the openings 16 therein. As depicted in FIGS. 3 and 5, the shaft 10 of the railroad spike fits snugly into slot 16 of plate 18. When key 20 is introduced and pounded into place, it holds shaft 10 more firmly against plate 18 and rail 17 because of the wedging or locking action of the bottom 21 of key 20. Removal of shaft 10 from the configuration shown in FIG. 5 is virtually impossible unless key 20 is first removed. This high degree of stability is extremely desirable in railroad bed construction.

FIGS. 6C through 6F show different stages of insertion of key 20 into key way 12, and the resulting protrusion of the bottom edge 21 of the key into the medium 19, in this case a railroad tie. By the time key 20 is fully engaged (FIG. 6F), the bottom edge 21 has passed a significant distance into the railroad tie medium 19. Key 20 may be of various lengths, longer lengths resulting in greater protrusion into the medium.

In use, the key lock spike of the present invention is used by first hammering the notched spike through base plate 18 into a railroad tie so that the lip of head 15 holds rail 17 in place. Then, key 20 is positioned so that angle 21 and angle 13 will come into contact with each other at the bottom of key way 12. (In alternative embodiments, this positioning is unnecessary.) Then key 20 is hammered into key way 12 such that as its bottom edge 21 bends at an angle into the medium 19 as the bottom 21 comes into contact with the bottom edge 13 of key way 12. The longer the length of the key 20, the farther it goes into the medium 19. The bottom of key 20 is shown with a tapered angle 21 on only one side; however, this angle may be on one, two, or all four sides of the bottom of key 20. Similarly, although the drawings depict key 20 with a square shaft, it may also have a rounded shaft to correspond with a rounded key way 12. In some applications, the key may be shaped like an ordinary nail.

Figure 7:
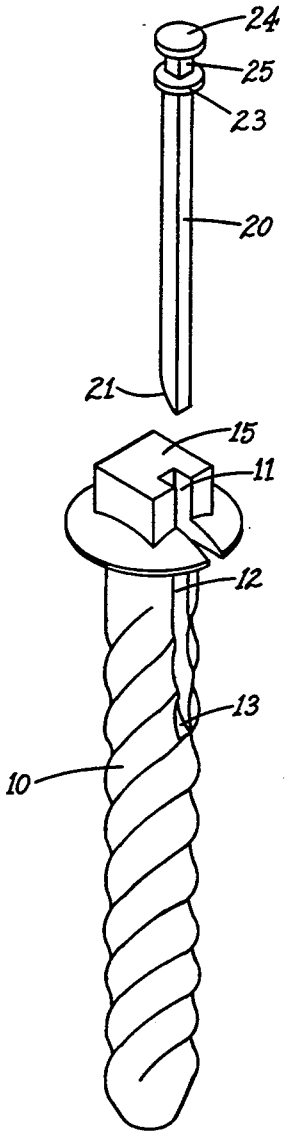
FIG. 7 is an alternative embodiment of the present invention showing a screw type railroad spike.

There are four alternative embodiments depicted in FIGS. 7, 8, 9 and 10. The embodiment shown in FIG. 7 is first screwed into a medium 19. Then, key 20 is inserted as described above so that the bottom 21 of key 20 protrudes into medium 19 after it comes into contact with the bottom edge 13 of key way 12.

Figure 8:
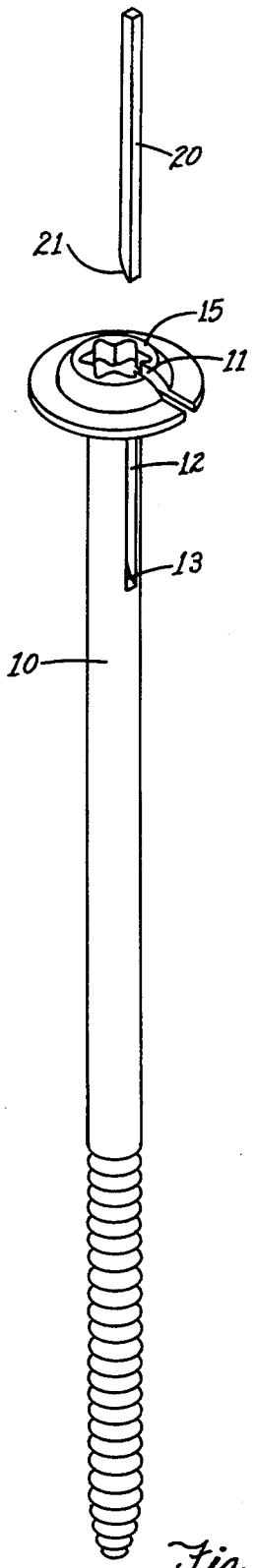
FIG. 8 is an alternative embodiment of the present invention showing an elongated screw type railroad spike used for holding railroad ties together.

Similarly, the embodiment shown in FIG. 8 is designed to be screwed through one railroad tie and into another in order to hold two railroad ties together. Then, key 20 is inserted into key way 12 so that when it is hammered down, the bottom 21 of the key protrudes into the medium. The top 23 of the key 20 may be designed so that it will be flush with the top 15 of the screw spike of this embodiment; however, this key 20 may have no top 23 at all.

Figure 9:
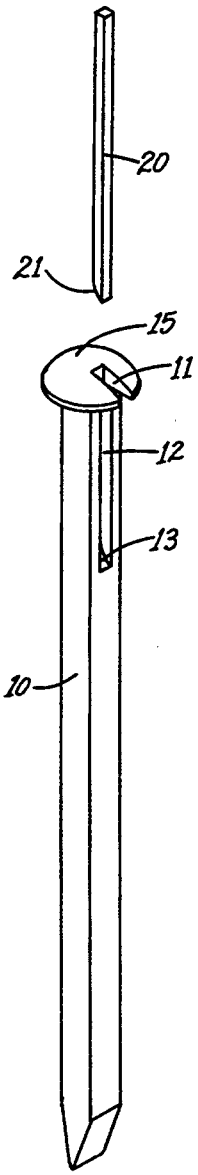
FIG. 9 is an alternative embodiment of the present invention showing a bridge, pier, or dock spike having a rounded head.
Figure 10:
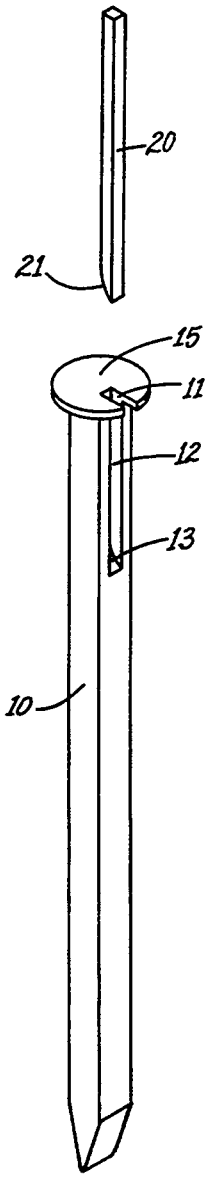
FIG. 10 is an alternative embodiment of the present invention showing a flat headed nail or spike.

The embodiment shown in FIGS. 9 and 10 differ in that FIG. 9 shows a dome shaped head, and FIG. 10 shows a flat head on a spike. As with the embodiment shown in FIG. 8, the top 23 of key 20 may be designed to fit flush with the top 15 of the spike after key 20 has been hammered into place. Each of the embodiments of FIGS. 8, 9 and 10 shows a key having a specially adapted head 23 that fits flush with the head 15 of the spike. However, the keys and the key ways shown in FIGS. 7 through 10 may each be rounded, and may each be provided without head 23 at all.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A locking spike comprising:

a. a first elongated shaft having a rectangular cross-section defining four sides, a head at one end, and a point at the opposite end, said head having a lip extending over one of said four sides;

b. a longitudinal groove on the side opposite said lip extending from the head part way down said side;

c. an outwardly tapered angle in said groove at the end opposite said head; and d. a second elongated shaft having a rectangular cross-section defining four sides sized to fit snugly into said groove having a corresponding tapered angle at the bottom thereof;

whereby after said first shaft is inserted into a medium, said second shaft is inserted into the groove of said first shaft so that as the tapered bottom of said second shaft contacts the tapered end of the groove said second shaft bends and protrudes outwardly and away from said first shaft into said medium for wedging said first shaft against a rail member.

2. The spike described in claim 1 wherein said second shaft is provided with a head.

3. The spike described in claim 2 wherein the head of said second shaft is shaped to fit flush with the head of said first shaft when said second shaft is fully inserted into said groove.

4. The spike described in claim 3 wherein said first shaft is a screw-type railroad spike.

5. The spike described in claim 3 wherein said first shaft is an elongated rounded railroad spike having screw threads around the bottom thereof used for holding railroad ties together.

6. The spike described in claim 3 wherein said first shaft has a rounded dome head.

7. The spike described in claim 3 wherein said first shaft has a flat head.

8. The spike described in claim 1 wherein said second shaft is provided with a pair of heads.

9. The spike described in claim 1 wherein said first shaft is a large screw.

10. In combination, a locking spike and base plate comprising:

a. a first elongated shaft having a rectangular cross-section defining four sides, a head at one end, and a point at the opposite end, said head having a lip extending over one of said four sides;

b. a longitudinal groove on the side opposite said lip extending from the head part way down said side;

c. an outwardly tapered angle in said groove at the end opposite said head;

d. a second elongated shaft having a rectangular cross-section defining four sides sized to fit snugly into said groove having a corresponding tapered angle at the bottom thereof; and e. an opening in said base plate through which said first shaft slides snugly;

whereby after said first shaft is inserted through the opening in said plate into a medium, said second shaft is inserted into the groove of said first shaft so that said second shaft locks into said plate as well as into said medium as the tapered bottom of said second shaft contacts the tapered end of the groove bending and protruding said second shaft outwardly and away from said first shaft into said medium for wedging said first shaft against said plate.

11. The spike described in claim 10 wherein said second shaft is provided with a head.

12. The spike described in claim 10 wherein said second shaft is provided with a pair of heads.

13. The spike described in claim 10 wherein the sides of said groove and the sides of said second shaft are rounded.

14. The spike described in claim 13 wherein said second shaft is pointed at the bottom.

* * * * *